US007091863B2

(12) United States Patent
Ravet

(10) Patent No.: US 7,091,863 B2
(45) Date of Patent: Aug. 15, 2006

(54) SYSTEM AND METHOD FOR TRACKING THE MOVEMENT AND LOCATION OF AN OBJECT IN A PREDEFINED AREA

(76) Inventor: Gary Ravet, P.O. Box 1083, La Jolta, CA (US) 90238

( * ) Notice: Subject to any disclaimer, the term of this patent is extended or adjusted under 35 U.S.C. 154(b) by 47 days.

(21) Appl. No.: 10/860,874

(22) Filed: Jun. 3, 2004

(65) Prior Publication Data

US 2005/0270156 A1 Dec. 8, 2005

(51) Int. Cl.
*G08B 13/14* (2006.01)

(52) U.S. Cl. ..... 340/572.1; 340/572.8; 340/572.9; 340/686.1

(58) Field of Classification Search ..... 340/572.1, 340/572.4, 572.8, 572.9, 539.1, 539.13, 686.1, 340/323 R; 345/848, 849; 702/141, 149; 342/42, 118

See application file for complete search history.

(56) References Cited

U.S. PATENT DOCUMENTS

| | | | | |
|---|---|---|---|---|
| 5,446,701 | A * | 8/1995 | Utke et al. | 367/118 |
| 5,883,569 | A * | 3/1999 | Kolefas | 340/384.1 |
| 6,148,271 | A * | 11/2000 | Marinelli | 702/141 |
| 6,353,406 | B1 * | 3/2002 | Lanzl et al. | 342/118 |
| 6,661,342 | B1 * | 12/2003 | Hall et al. | 340/573.1 |
| 6,717,516 | B1 | 4/2004 | Bridgelall | 340/572.1 |
| 6,717,923 | B1 | 4/2004 | Smith | 340/10.1 |
| 6,720,866 | B1 | 4/2004 | Sorrells et al. | 340/10.4 |
| 6,720,930 | B1 | 4/2004 | Johnson et al. | 343/742 |
| 6,737,508 | B1 * | 5/2004 | Pelletier et al. | 530/326 |
| 2003/0073518 | A1 | 4/2003 | Marty et al. | 72/129 |
| 2003/0201321 | A1 | 10/2003 | Maloney | 209/34 |
| 2003/0214388 | A1 | 11/2003 | Stuart et al. | 209/34 |
| 2003/0220159 | A1 | 11/2003 | Hamons et al. | 40/768 |
| 2003/0220711 | A1 | 11/2003 | Allen | 72/398 |
| 2003/0231107 | A1 | 12/2003 | Edmonson et al. | 16/71 |
| 2004/0027241 | A1 | 2/2004 | Forster | 369/151 |

FOREIGN PATENT DOCUMENTS

| | | |
|---|---|---|
| WO | WO 01/49379 A2 * | 7/2001 |

* cited by examiner

*Primary Examiner*—Van T. Trieu
(74) *Attorney, Agent, or Firm*—Jennifer Meredith; Meredith & Keyhani PLC

(57) ABSTRACT

A preferred embodiment includes a system for tracking the movement and location of an object in a predefined area. The system comprises an object having at least one readable sensor contained therein. The at least one readable sensor transmits a unique signal. There is also at least one reader at a preselected, proximate location, wherein the at least one reader reads each unique signal from each at least one readable sensor as each sensor moves through the predefined area. There is also a control system. The control system is programmed to use the unique signal from each at least one readable sensor to precisely locate each object within the predefined area. There is also a communication link between each at least one reader and the control system.

56 Claims, 5 Drawing Sheets

SYSTEM AND METHOD FOR TRACKING THE MOVEMENT AND LOCATION OF AN OBJECT IN A PREDEFINED AREA

BACKGROUND OF THE INVENTION

Electronic tracking and identification systems have evolved significantly over the years. These systems typically comprise at least two devices which are configured to communicate with each other. Preferred configurations involve electronic identification of unique items within a group and communication across a wireless medium. These types of solutions have increasingly been used to track inventory, itemize stock, or simply protect expensive store merchandise from being removed from a building or certain location.

An increasingly common means to track objects in such a manner is by use of a radio frequency identification (RFID) device. The use of an RFID device eases the integration and use of a wireless tracking solution. The transmitters can be quite small in size and work passively.

Smith, in U.S. Pat. No. 6,717,923, teaches a communication device using a radio frequency identification device and methods of communicating. However this device is limited in its scope to finding and identifying the location of objects at fixed locations within a warehouse or storage facility.

In U.S. Pat. No. 6,717,516, issued to Bridgelall, a RFID based Real Time Location Tracking Device is disclosed. This device employs wireless communication using Bluetooth® technology. A plurality of fixed readers receive RFID signals used to locate and identify items which emit the signals.

The present invention relates to tracking objects, more specifically a system where a central control system tracks an object's range of motion across a predefined area. A preferred embodiment includes, but is not limited to a system where the object to be tracked is a football and the predefined area being the football field. The novel and unique element is the combination of functionality which goes far beyond that of a typical RFID tracking or locating system. The present invention employs the use of locator devices, which may be activated by a triggering mechanism such as a clicker or whistle and encrypted wireless signals.

SUMMARY OF THE INVENTION

The present invention relates to tracking objects, more specifically a system where a central control system tracks an object's range of motion across a predefined area.

A preferred embodiment includes a system for tracking the movement and location of an object in a predefined area. The system comprises an object having at least one readable sensor contained therein. The at least one readable sensor transmits a unique signal. There is also at least one reader at a preselected, proximate location, wherein the at least one reader reads each unique signal from each at least one readable sensor as each sensor moves through the predefined area. There is also a control system. The control system is programmed to use the unique signal from each at least one readable sensor to precisely locate the object within the predefined area. There is also a communication link between each at least one reader and the control system.

An alternate embodiment includes a system for tracking the movement and location of an object in a predefined area. The system is comprised of an object having at least two readable sensors contained therein. The two readable sensors are positioned on opposing edges of the object and each of the at least two readable sensors transmits a unique signal. There is also at least one reader at a preselected, proximate location. Each at least one reader reads each unique signal from each at least two readable sensors as the sensors move through the predefined area. There is also a control system. The control system is programmed to use the unique signal from each at least one readable sensor to precisely locate the object within the predefined area. There is also a communication link between each at least one reader and the control system. The communication link transmits each unique signal received from each at least two readable sensors to each at least one reader to the control system.

Yet another alternate embodiment includes a system for tracking the movement and location of an object in a predefined area. The system comprises an object having at least two readable sensors contained therein. Each of the at least two readable sensors are positioned on opposing edges of the object and each of the two readable sensors transmits a unique signal. There is also at least one reader at a preselected, proximate location. Each at least one reader reads each unique signal from each at least two readable sensors as the sensors move through the predefined area. There also is a control system. The control system is programmed to use each unique signal from each at least one readable sensor to precisely locate the object within the predefined area. There is also at least one locator device in communication with the control system. There is also a trigger mechanism. The trigger mechanism is in communication with the control system and upon activation of the trigger mechanism the control system records the location of each at least two readable sensors. There also is a communication link between each at least one reader and the control system. The communication link transmits each unique signal received from each at least one readable sensor to each at least one reader to each control system.

An alternate embodiment includes a system for tracking the movement and location of an object in a predefined area. The system comprises an object. Wherein the object is a football, having an outer surface and an inner air bladder and at least two readable sensors are positioned between the air bladder and the outer surface at opposing edges of the football. Each of the at least two readable sensors transmits a unique signal. There also is at least one reader at a preselected, proximate location, wherein each at least one reader reads each unique signal from each at least two readable sensors as the sensors move through the predefined area. There also is a control system, wherein the control system is a personal computer programmed to use the unique signal from each at least one readable sensor to precisely locate the object within the predefined area. The predefined area is divided into a two dimensional, planar grid and the control system is programmed to determine the precise location, speed and distance traveled of the object based on its location within the two dimensional, planar grid. There also is at least one locator device in communication with the control system. There also is a trigger mechanism, wherein the trigger mechanism is in communication with the control system. Upon activation of the trigger mechanism the control system records the location of each at least two readable sensors. There also is a communication link between each at least one reader and the control system, wherein the communication link transmits the unique signal received from each at least one readable sensor to each at least one reader to the control system.

An alternate embodiment includes a method for tracking the movement and location of an object in a predefined area, comprising a first step of providing a control system. The step of providing at least one reader in communication with the control system. Wherein each at least one reader is positioned at a preselected, proximate location to the predefined area. The step of providing at least one readable sensor contained within the object. Wherein each at least one readable sensor emits a unique signal. The step of calibrating the predefined area into a two dimensional, planar grid. The step of receiving each unique signal from each at least one readable sensor by each at least one reader. Transmitting each unique signal received from each at least one readable sensor from each at least one receiver to the control system. Tracking the movement and location of the object within the two dimensional, planar grid on the control system.

Yet another embodiment includes a method for tracking the movement and location of an object in a predefined area, comprising a first step of providing a control system. Wherein the control system is a personal computer. The step of providing at least one reader in communication with the control system. Wherein each at least one reader is positioned at a preselected, proximate location to the predefined area. The step of providing at least two readable sensor contained within the object. Wherein the object is a football having an outer surface and an inner air bladder and the two readable sensors are positioned between the air bladder and the outer surface at opposing edges of the football and each at least two readable sensor emits a unique signal. The step of providing a trigger mechanism in communication with the control system. Upon activation of the trigger mechanism the control system records the location of each at least two readable sensors. The step of providing at least one tracking device in communication with the control system. The at least one tracking device follows the location of each at least one readable sensor within the two dimensional, planar grid. The step of calibrating the predefined area into a two dimensional, planar grid. Wherein the step of calibrating the predefined area into a two dimensional, planar grid is done by walking the object to each corner of the predefined area. The step of inputting a prefix condition which dictates the direction the object is moving. Receiving each unique signal from each at least two readable sensors by each at least one reader. The step of transmitting each unique signal received from each at least two readable sensors from each at least one receiver to the control system. Wherein each unique signal is transmitted at predetermined time intervals. The step of inputting the predetermined time intervals into the control system. The step of tracking the movement and location of the object within the two dimensional, planar grid on the control system.

This summary is not to be taken in a limiting sense, but is made merely for the purpose of illustrating the general principles of the invention, since the scope of the invention is best defined by the appended claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
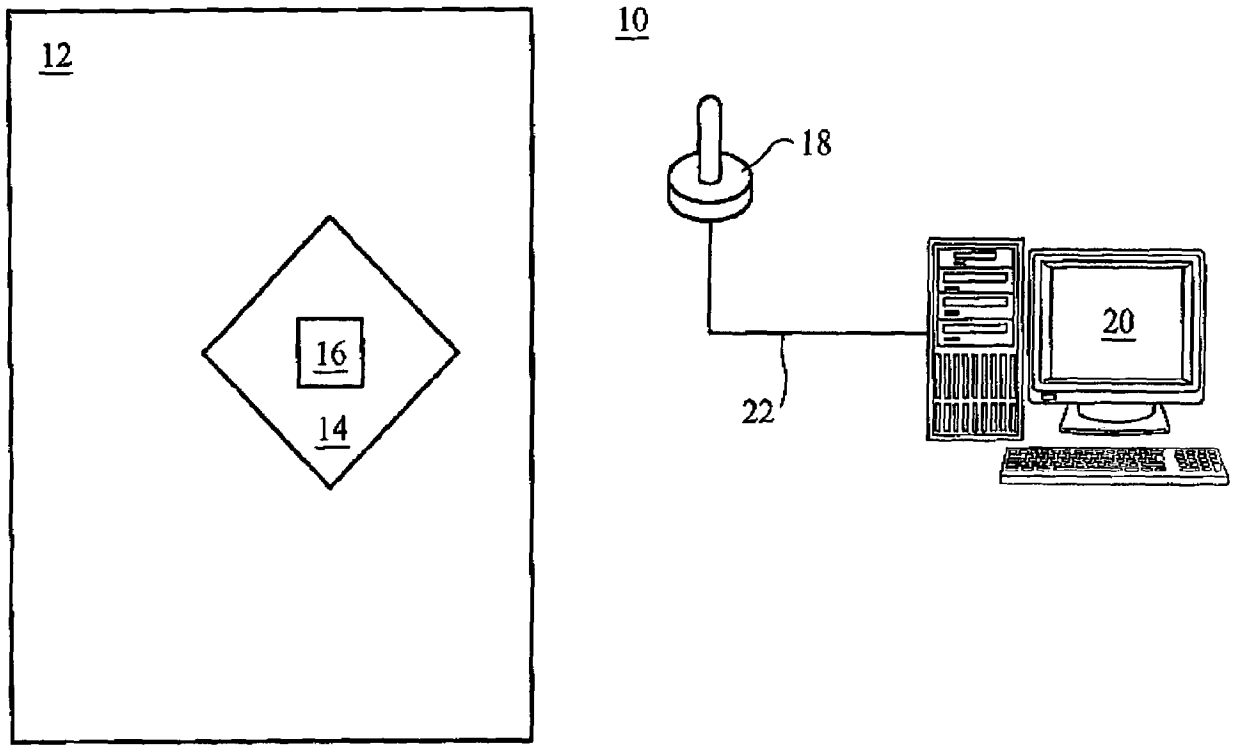
FIG. 1 depicts a system according to a preferred embodiment.

It is envisioned that the present invention may be used to track a football and to prevent referee error with respect to judging where to place or spot the football after a play. FIG. 1 depicts a system 10 for tracking the movement and location of an object in a predefined area. The system 10 includes at least one object 14 with at least one readable sensor 16 contained therein. The at least one object 14 may be, but is not limited to, sports related objects such as a football, baseball, soccer ball or simply a key tag, The system 10 is designed to track the movement, position and speed of the object 14 as it moves throughout a predefined area 12. The predefined area 12 may be any area in which the at least one object is located. For example, the predefined area 12 may be but is not limited to an athletic field (e.g. a football field) a track or a building. This is accomplished by use of at least one reader 18 located at a proximate location to the predefined area 12. The at least one reader(s) 18 positioned at proximate locations divide the predefined area 12 into a grid which allows the precise present location and past locations to be collected and the speed and acceleration to be determined. The at least one reader 18 may be any type of signal receiver, this may include, but is not limited to Global Positioning Receiver, radio receiver, optical receiver. The at least one reader 18 may detect the location of the at least one object 14 in the predefined area 12. The at least one reader 18 is in communication with a control system 20 through a communication link 22. The at least one reader 18 may include an antenna for communicating with a control system 20. The communication link 22 may be a wired connection (e.g. category 5, RJ-45 or coaxial cable) or a wireless link (e.g. RF transmission, IEEE 802.11 a/b/g or Bluetooth®). The communication may be encrypted with any means standard within the art for securing wired or wireless signals to prevent any unauthorized party to access the system.

An example of implementation of a preferred embodiment of the present invention may be recording the acceleration, speed or tracking the position of a football on a football field while a game is being played. In this situation, the at least one reader(s) 18 may be positioned in at least one location proximate to the predefined area 12 (i.e. playing field). The at least one reader(s) 18 would divide the predefined area 12 (i.e. playing field) into a grid and track the location of the object 14 (i.e. football). As the object 14 (i.e. football) is being moved around the predefined area 12 (i.e. playing field) the corresponding grid coordinate location of the object 14 (i.e. football) as determined by the at least one reader(s) 18 would be transmitted from the at least one reader(s) 18 to the control system 20. The control system 20 may be a computer located somewhere in the proximity of the predefined area 12 (i.e. playing field) collects and processes the received data. The control system 20 may store and utilize the positional data of the object 14 (i.e. football) to extrapolate other meaningful information such as orientation, speed, acceleration or orientation.

Figure 2:
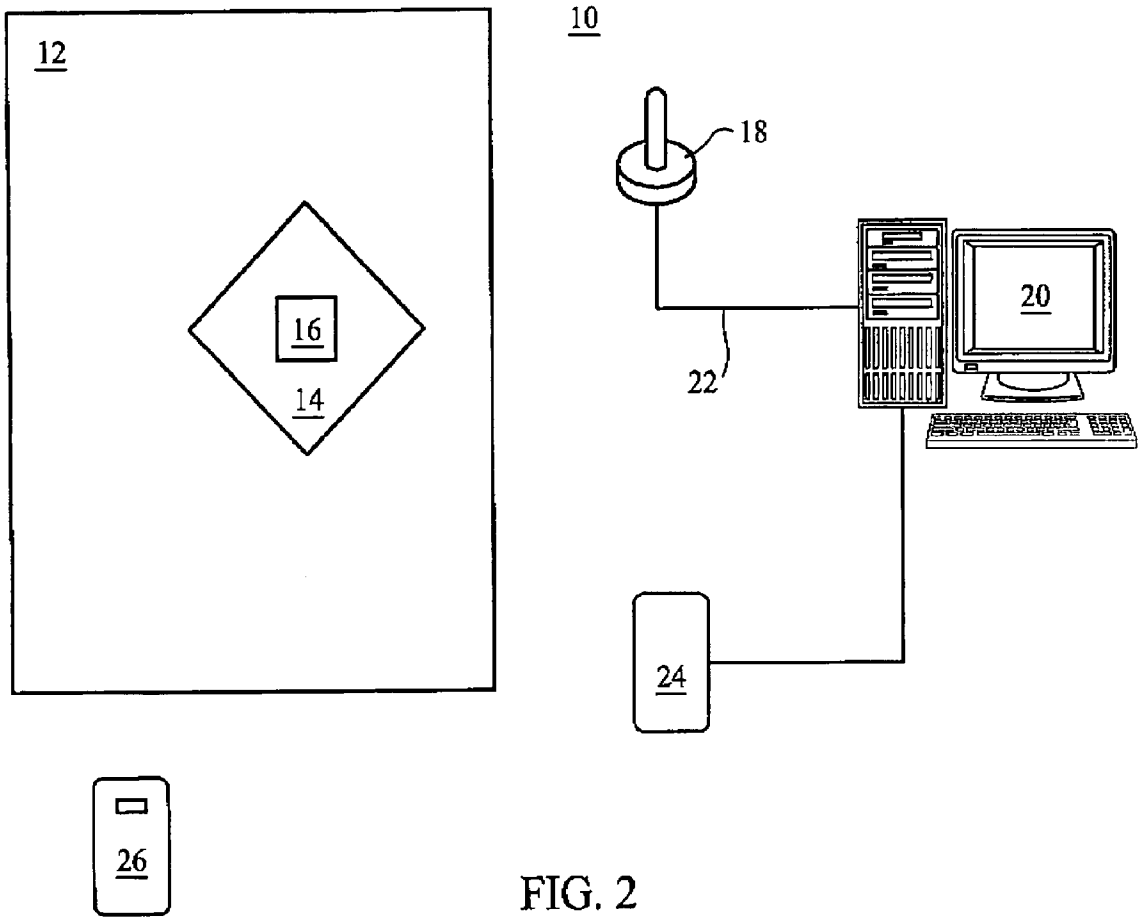
FIG. 2 depicts a system according to a preferred embodiment.

FIG. 2 depicts an alternate system 10 for tracking the movement and location of at least one object 14 in a predefined area 12. The system 10 includes a predefined area 12 and at least one object 14 with at least one readable sensor 16 contained therein. The at least one object 14 may be but is not limited to sports related objects such as a football, baseball, soccer ball, or may also simply be a key tag, The predefined area 12 may be but is not limited to a warehouse, parking lot or an athletic playing field (e.g. football field), or track. The object 14 has at least one readable sensor 16 contained within it. The at least one readable sensor 16 may be any type of signal transmitter or transceiver, this may include but is not limited to GPS transmitter, radio frequency transmitter, infra red transmitter, laser transmitter. The at least one readable sensor 16 may be radio frequency tags. The radio frequency tags may be active radio frequency tags, or passive radio frequency tags that may be triggered by at least one reader 18 to transmit its unique signal. The system 10 may be designed to track the movement, position and speed of the object 14 as it moves throughout the predefined area 12. This is accomplished by use of at least one reader 18 located at at least one proximate location to the predefined area 12. The at least one reader 18 may be any type of signal receiver or transceiver, this may include but is not limited to Global Positioning Receiver, radio receiver, infra red receiver, laser receiver. In a preferred embodiment, the predefined area 12 may be a square region (e.g. a football field) and there may be four readers, each located proximate to each corner of the region. Each at least one reader 18 is connected to a control system 20 through a communication link 22. The at least one reader 18 may also include an antenna for communication with the control system 20.

The control system 20 is also connected to a trigger mechanism 26 and at least one locator device 24. The at least one locator device 24 may be an optical pointer-type device (e.g. a laser pointer). The at least one locator device 24 is also connected to the control system 20 through a communication link 30 (either wired or wireless and capable of being encrypted). The trigger mechanism 26 may be a small device capable of sending a trigger signal to the control system 20 when actuated. This device could be designed in the form of a keytag similar to the remote entry actuators commonly used by automobile manufacturers. The trigger signal may be either a radio frequency signal or an optical signal to the control system 20 upon actuation of the trigger mechanism 26. This technology could also be implemented into a whistle device, which when blown may send a trigger signal to the control system 20. This trigger mechanism 26, like the at least one locator device 24 and the at least one reader 18 is also connected to the control system 20 by means of a communication link 28. This communication link 28, like the others used may be wired or wireless in nature and may be secured or encrypted using common methods known within the art.

Another example of implementation of a preferred embodiment of the present invention may be tracking the position of a football on a football field while a game is being played. In this situation, the at least one reader(s) 18 may be positioned in at least one location proximate to the predefined area (i.e. playing field). Within the football are two readable sensors 16, positioned on opposite edges of the football. The two readable sensors 16 that transmit unique signals are in communication with the at least one reader(s) 18. The at least one reader(s) 18 would divide the playing field into a grid and track the location of the two readable sensors 16 located inside the football. As the football is being moved around the playing field the corresponding grid coordinate locations of both readable sensors in the football is determined by the at least one reader(s) 18. The at least one reader(s) 18 would transmit the respective coordinate locations to the control system 20. The control system 20, which in this case may be a computer located somewhere in the proximity of the playing field collects and processes the received data. The control system 20 may store and utilize the positional data of the football to extrapolate other meaningful information such as orientation, speed acceleration, orientation.

Figure 3:
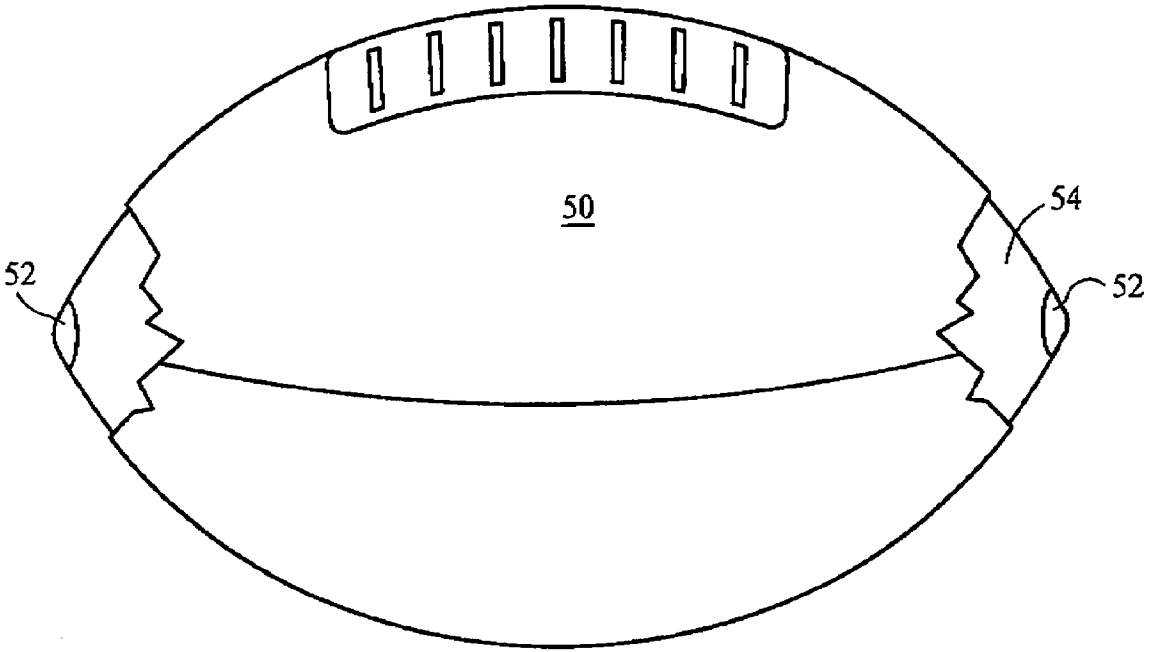
FIG. 3 depicts a football as the object to be tracked.

FIG. 3 shows a football 48 as the object 14, according to a preferred embodiment. The football 48 is comprised of an outer covering 50 (usually leather) with an inner air bladder 54. There are two readable sensors 52 positioned on opposing corners of the football 48 positioned between the air bladder 54 and the outer covering 50. There may also be multiple readable sensors 52 positioned in various locations in the football 48. The readable sensors 52 may be positioned within the inner air bladder 54 and/or between the outer covering 50 and the inner air bladder 54. Having at least one readable sensor(s) 52 positioned in the football 48 allows for the orientation of the football 48 to be determined along and other information relating to position.

Figure 4:
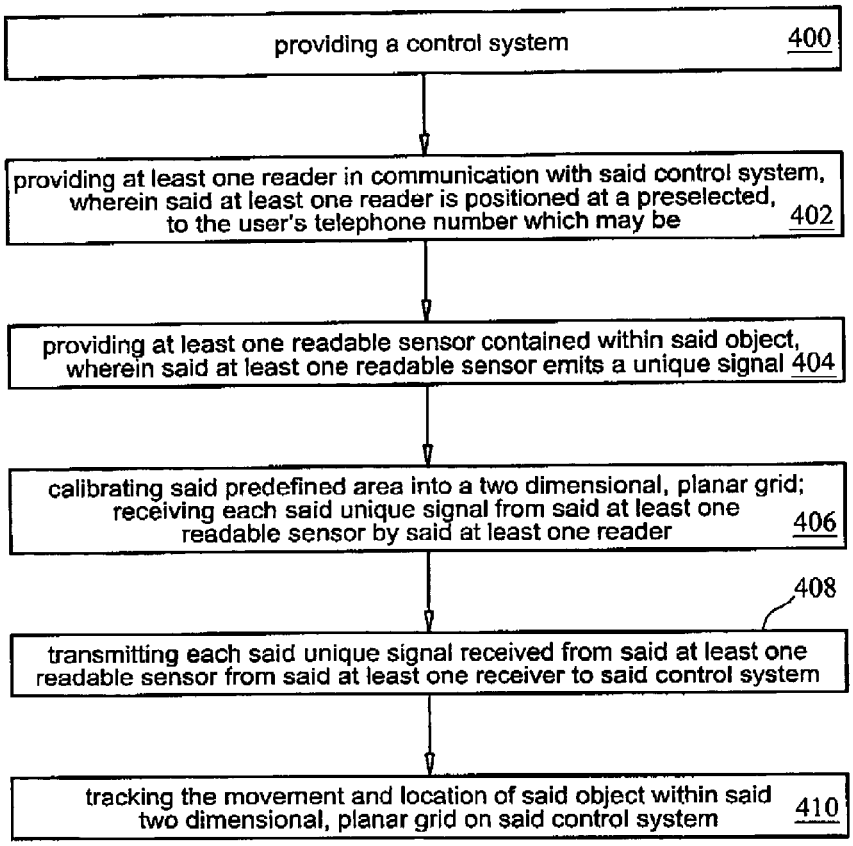
FIG. 4 depicts a method for providing a preferred embodiment.

FIG. 4 shows the necessary steps for providing such a system as disclosed above. The method may include the following steps: Step 400: providing a control system. Step 402: providing at least one reader 18 in communication with the control system 20. These readers 18 are positioned at a preselected, proximate location to the predefined area 12. The predefined area 12 may be any area in which the at least one object 14 is located. For example, the predefined area 12 may be but is not limited to a playing field, such as a football field, or may also be a track. The reader 18 may be any type of signal receiver or transceiver, this may include but is not limited to Global Positioning Receiver, radio receiver, infra red receiver, laser receiver. Step 404: providing at least one readable sensor 16 contained within the object 14. Each readable sensor 16 emits a unique signal. The at least one readable sensor 16 may be any type of signal transmitter or transceiver, this may include but is not limited to GPS transmitter, radio frequency transmitter, infra red transmitter, laser transmitter, Step 406: calibrating the predefined area 12 into a two dimensional, planar grid. It is envisioned that the predefined area 12 may also be calibrated into a three dimensional grid. Step 408; receiving each unique signal from each at least one readable sensor 16 by each at least one reader 18. Step 410: transmitting each unique signal received from each at least one readable sensor 16 from each at least one reader 18 to the control system. Step 412: tracking the movement and location of the object 14 within the two dimensional, planar grid on the control system 20.

Figure 5:
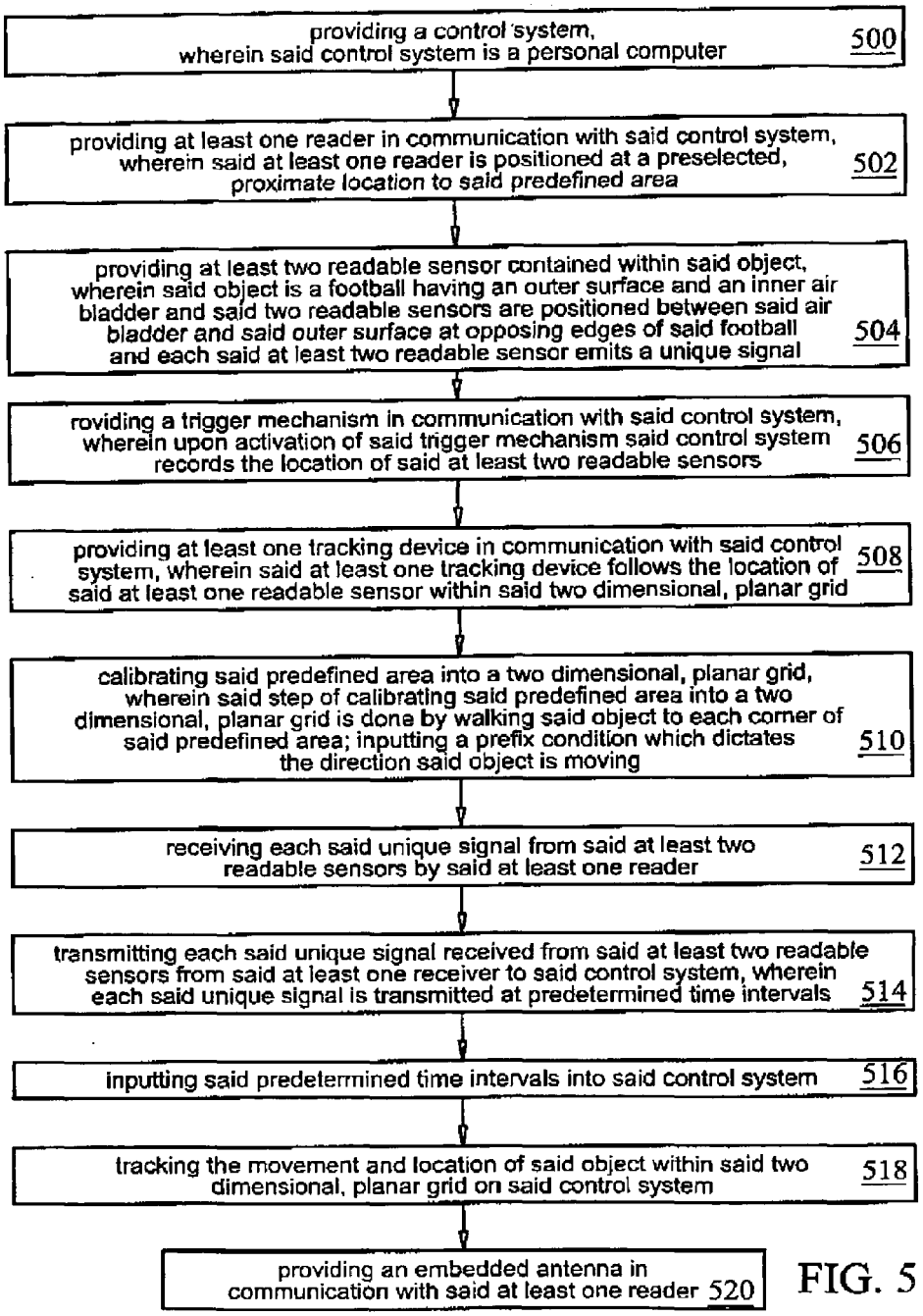
FIG. 5 depicts a method for providing a preferred embodiment.

FIG. 5 shows the steps to provide such a system in an alternate embodiment. The method may include the following steps: Step 500: providing a control system 20. The control system 20 is a personal computer. Step 502: providing at least one reader 18 in communication with the control system 20. The at least one reader 18 may be any type of signal receiver or transceiver, this may include but is not limited to Global Positioning Receiver, radio receiver, infra red receiver, laser receiver. Each reader 18 is positioned at a preselected, proximate location to the predefined area 12. The predefined area 12 may be any area in which the at least one object 14 is located. For example, the predefined area 12 may be but is not limited to a playing field, such as a football field, or may also be a track. Step 504: providing at least two readable sensors 16 contained within the object 14. The two readable sensors 16 may be any type of signal transmitter or transceiver, this may include but is not limited to GPS transmitter, radio frequency transmitter, infra red transmitter, laser transmitter. The object 14 is a football 48 having an outer covering 50 and an inner air bladder 54 and the two readable sensors 16, 52 are positioned between the inner air bladder 54 and the outer covering 50 at opposing edges of the football 48 and each at least two readable sensors 16,52 emit a unique signal. Step 506: providing a trigger mechanism 26 in communication with the control system 20. Upon activation of the trigger mechanism 26 the control system 20 records the location of each at least two readable sensors 16. The trigger mechanism 26 may be a small device capable of sending a trigger signal to the control system 20 when actuated. This device could be designed in the form of a keytag similar to the remote entry actuators commonly used by automobile manufacturers. This technology could also be implemented into a whistle device, which when blown may send a trigger signal to the control system 20. The trigger signal may be either a radio frequency signal or an optical signal to the control system upon actuation of the trigger mechanism. Step 508: providing at least one locator device 24 in communication with the control system 20. The at least one locator device 24 follows the location of each at least one readable sensor 16 within the predefined area 12. Step 510: calibrating the predefined area 12 into a two dimensional, planar grid. Wherein the step of calibrating the predefined area 12 into a two dimensional, planar grid is done by walking the object 14 to each corner of the predefined area 12. Step 512: inputting a prefix condition which dictates the direction the object 14 is moving. Step 514: receiving each unique signal from each at least two readable sensors 16 by each at least one reader 18. Step 516: transmitting each unique signal received from each at least two readable sensors 16 from each at least one receiver 18 to the control system 20. Each unique signal is transmitted at predetermined time intervals. Step 518: inputting the predetermined time intervals into the control system 20. Step 520: tracking the movement and location of the object 14 within the two dimensional, planar grid on the control system 20.

This description is not to be taken in a limiting sense, but is made merely for the purpose of illustrating the general principles of the invention, since the scope of the invention is best defined by the appended claims.

The invention claimed is:

1. A system for tracking the movement and location of an object in a predefined area, said system comprising:

an object having at least two readable sensors contained therein on opposing edges of said object, wherein each said at least one readable sensor detects the position and location of an edge of said object and transmits a unique signal;

at least one reader at a preselected, proximate location, wherein said at least one reader reads each said unique signal from said at least one readable sensor as said sensor moves through said predefined area;

a control system, wherein said control system is programmed to use said unique signal from said at least one readable sensor to precisely locate said object within said predefined area; and a communication link between said at least one reader and said control system.

2. A system as in claim 1, further comprising:

at least one locator device in communication with said control system.

3. A system as in claim 1, further comprising:

a trigger mechanism, wherein said trigger mechanism is in communication with said control system and upon activation of said trigger mechanism said control system records the location of said at least one readable sensor.

4. A system as in claim 1, further comprising:

an embedded antenna in communication with said at least one reader.

5. A system as in claim 1, wherein said at least one readable sensor is comprised of two readable sensors positioned on opposing edges of said object.

6. A system as in claim 5, wherein said object is a football, having an outer surface and an inner air bladder, wherein said two readable sensors are positioned between said air bladder and said outer surface at opposing edges of said football.

7. A system as in claim 1, wherein said object is a football, having an outer surface and an inner air bladder and said at least one readable sensor is positioned between said air bladder and said outer surface.

8. A system as in claim 1, wherein said communication link transmits said unique signal received from said at least one readable sensor to said at least one reader to said control system.

9. A system as in claim 1, wherein said at least one readable sensor is a radio frequency (RF) tag.

10. A system as in claim 1, wherein said at least one readable sensor is a passive RF tag and is triggered by said at least one reader to transmit said unique signal.

11. A system as in claim 1, wherein said at least one readable sensor is an active RF tag.

12. A system as in claim 1, wherein said predefined area is divided into a two dimensional, planar grid and said control system is programmed to determine the location, speed and distance traveled of said object based on its location within said two dimensional, planar grid.

13. A system as in claim 1, wherein said control system is a personal computer.

14. A system for tracking the movement and location of an object in a predefined area, said system comprising:

an object having at least two readable sensors contained therein, wherein said two readable sensors are positioned on opposing edges of said object and each of said at least two readable sensors detects the position and location of an edge of said object and transmits a unique signal;

at least one reader at a preselected, proximate location, wherein said at least one reader reads each said unique signal from said at least two readable sensors as said sensors move through said predefined area;

a control system, wherein said control system is programmed to use said unique signal from said at least one readable sensor to precisely locate said object within said predefined area; and a communication link between said at least one reader and said control system, wherein said communication link transmits each said unique signal received from said at least two readable sensors to said at least one reader to said control system.

15. A system as in claim 14, further comprising:

at least one locator device in communication with said control system.

16. A system as in claim 14, further comprising:

a trigger mechanism, wherein said trigger mechanism is in communication with said control system and upon activation of said trigger mechanism said control system records the location of said at least two readable sensors.

17. A system as in claim 14, further comprising:
an embedded antenna in communication with said at least one reader.

18. A system as in claim 14, wherein said object is a football, having en outer surface and an inner air bladder, wherein said at least two readable sensors are positioned between said air bladder and said outer surface at opposing edges of said football.

19. A system as in claim 14, wherein said at least two readable sensors are radio frequency (RF) tags.

20. A system as in claim 14, wherein said at least two readable sensors are passive RF tags and are triggered by said at least one reader to transmit said unique signals.

21. A system as in claim 14, wherein said at least two readable sensors are active RF tags.

22. A system as in claim 14, wherein said predefined area is divided into a two dimensional, planar grid and said control system is programmed to determine the precise location, speed and distance traveled of said object based on its location within said two dimensional, planar grid.

23. A system as in claim 14, wherein said control system is a personal computer.

24. A system for tracking the movement and location of an object in a predefined area, said system comprising;
an object having at least two readable sensors contained therein, wherein said two readable sensors are positioned on opposing edges of said object and each of said two readable sensors detects the position and location of an edge of said object and transmits a unique signal;
at least one reader at a preselected, proximate location, wherein said at least one reader reads each said unique signal from said at least two readable sensors as said sensors move through said predefined area;
a control system, wherein said control system is programmed to use said unique signal from said at least one readable sensor to precisely locate said object within said predefined area;
at least one locator device in communication with said control system;
a trigger mechanism, wherein said trigger mechanism is in communication with said control system and upon activation of said trigger mechanism said control system records the location of said at least two readable sensors; and
a communication link between said at least one reader and said control system, wherein said communication link transmits said unique signal received from said at least one readable sensor to said at least one reader to said control system.

25. A system as in claim 24, further comprising:
an embedded antenna in communication with said at least one reader.

26. A system as in claim 24, wherein said object is a football, having an outer surface and an inner air bladder, wherein said at least two readable sensors are positioned between said air bladder and said outer surface at opposing edges of said football.

27. A system as in claim 24, wherein said at least two readable sensors are radio frequency (RF) tags.

28. A system as in claim 24, wherein said at least two readable sensors are passive RF tags and are triggered by said at least one reader to transmit said unique signals.

29. A system as in claim 24, wherein said at least two readable sensors are active RF tags.

30. A system as in claim 24, wherein said predefined area is divided into a two dimensional, planar grid and said control system is programmed to determine the precise location, speed and distance traveled of said object based on its location within said two dimensional, planar grid.

31. A system as in claim 24, wherein said control system is a personal computer.

32. A system for tracking the movement and location of an object in a predefined area, said system comprising:
an object, wherein said object is a football, having an outer surface and an inner air bladder, wherein at least two readable sensors are positioned between said air bladder and said outer surface at opposing edges of said football and each of said at least two readable sensors detects the position and location of an edge of said object and transmits a unique signal;
at least one reader at a preselected, proximate location, wherein said at least one reader reads each said unique signal from said at least two readable sensors as said sensors move through said predefined area;
a control system, wherein said control system is a personal computer programmed to use said unique signal from said at least one readable sensor to precisely locate said object within said predefined area, wherein said predefined area is divided into a two dimensional, planar grid and said control system is programmed to determine the precise location, speed and distance traveled of said object based on its location within said two dimensional, planar grid;
at least one locator device in communication with said control system;
a trigger mechanism, wherein said trigger mechanism is in communication with said control system and upon activation of said trigger mechanism said control system records the location of said at least two readable sensors; and
a communication link between said at least one reader and said control system, wherein said communication link transmits said unique signal received from said at least one readable sensor to said at least one reader to said control system.

33. A system as in claim 32, further comprising:
an embedded antenna in communication with said at least one reader.

34. A system as in claim 32, wherein said at least two readable sensors are radio frequency (RF) tags.

35. A system as in claim 32, wherein said at least two readable sensors am passive RF tags and are triggered by said at least one reader to transmit said unique signals.

36. A system as in claim 32, wherein said at least two readable sensors are active RF tags.

37. A method for tracking the movement and location of an object in a predefined area, comprising the steps of:
providing a control system;
providing at least one reader in communication with said control system, wherein said at least one reader is positioned at a preselected, proximate location to said predefined area;
providing at least two readable sensors contained within said object, wherein each said at least two readable sensors detects the position and location of an edge of said object and emits a unique signal;
calibrating said predefined area into a two dimensional, planar grid;
receiving each said unique signal from said at least one readable sensor by said at least one reader;
transmitting each said unique signal received from said at least one readable sensor from said at least one receiver to said control system; and tracking the movement and location of said object within said two dimensional, planar grid on said control system.

38. A method as in claim 37, further comprising the step of:

providing a trigger mechanism in communication with said control system, wherein upon activation of said trigger mechanism said control system records the location of said at least one readable sensor.

39. A method as in claim 37, further comprising the step of:

providing at least one tracking device in communication with said control system, wherein said at least one tracking device follows the location of said at least one readable sensor within said two dimensional, planar grid.

40. A method as in claim 37, further comprising the step of:

inputting a prefix condition which dictates the direction said object is moving.

41. A method as in claim 37, further comprising the step of:

providing an embedded antenna in communication with said at least one reader.

42. A method as in claim 37, wherein said at least one readable sensor is a radio frequency (RE) tag.

43. A method as in claim 37, wherein said at least one readable sensor is a passive RF tag and is triggered by said at least one reader to transmit said unique signal.

44. A method as in claim 37, wherein said at least one readable sensor is an active RF tag.

45. A method as in claim 37, wherein said step of calibrating said predefined area into a two dimensional, planar grid is done by walking said object to each corner of said predefined area.

46. A method as in claim 37, wherein said at least one readable sensor is two readable sensors.

47. A method as in claim 46, said object is a football having an outer surface and an inner air bladder and said two readable sensors are positioned between said air bladder and said outer surface at opposing edges of said football.

48. A method as in claim 37, wherein said predefined area is substantially rectangular.

49. A method as in claim 37, wherein said step of transmitting each said unique signal received from said at least one readable sensor from said at least one receiver to said control system is done at predetermined time intervals.

50. A method as in claim 49, further comprising the step of:

inputting said predetermined time intervals into said control system.

51. A method as in claim 37, wherein said control system is a personal computer.

52. A method for tracking the movement and location of an object in a predefined area, comprising the steps of:

providing a control system, wherein said control system is a personal computer;

providing at least one reader in communication with said control system, wherein said at least one reader is positioned at a preselected, proximate location to said predefined area;

providing at least two readable sensors contained within said object, wherein said object is a football having an outer surface and an inner air bladder and said two readable sensors are positioned between said air bladder and said outer surface at opposing edges of said football and each said at least two readable sensor detects the position and location of an edge of said object and emits a unique signal;

providing a trigger mechanism in communication with said control system, wherein upon activation of said trigger mechanism said control system records the location of said at least two readable sensors;

providing at least one tracking device in communication with said control system, wherein said at least one tracking device follows the location of said at least one readable sensor within said two dimensional, planar grid;

calibrating said predefined area into a two dimensional, planar grid, wherein said step of calibrating said predefined area into a two dimensional, planar grid is done by walking said object to each corner of said predefined area;

inputting a prefix condition which dictates the direction said object is moving;

receiving each said unique signal from said at least two readable sensors by said at least one reader;

transmitting each said unique signal received from said at least two readable sensors from said at least one receiver to said control system, wherein each said unique signal is transmitted at predetermined time intervals;

inputting said predetermined time intervals into said control system; and tracking the movement and location of said object within said two dimensional, planar grid on said control system.

53. A method as in claim 52, further comprising the step of:

providing an embedded antenna in communication with said at least one reader.

54. A method as in claim 52, wherein said at least two readable sensors are radio frequency (RF) tags.

55. A method as in claim 52, wherein said at least two readable sensors are passive RF tags and is triggered by said at least one reader to transmit said unique signal.

56. A method as in claim 52, wherein said at least two readable sensors are active RF tags.

* * * * *